US005339570A

United States Patent [19]

Amundson et al.

[11] Patent Number: 5,339,570

[45] Date of Patent: Aug. 23, 1994

[54] CONTACT WHEEL

[75] Inventors: Steven E. Amundson, Hastings; Arthur P. Luedeke, Marine on St. Croix, both of Minn.

[73] Assignee: Minnesota Mining and Manufacturing Company, St. Paul, Minn.

[21] Appl. No.: 931,016

[22] Filed: Aug. 17, 1992

[51] Int. Cl.[5] ..... B24B 21/14

[52] U.S. Cl. ..... 51/141; 51/135 R

[58] Field of Search ..... 51/141, 135 R

[56] References Cited

U.S. PATENT DOCUMENTS

| | | | |
|---|---|---|---|
| 2,257,864 | 10/1941 | Sheehan | 12/79.5 |
| 2,378,643 | 6/1945 | Losey | 51/141 |
| 2,527,554 | 10/1950 | Kimball | 51/141 |
| 2,530,960 | 11/1950 | Hall | 51/141 |
| 2,578,662 | 12/1951 | Bader | 51/148 |
| 2,639,560 | 5/1953 | Cosmos | 51/141 |
| 2,701,431 | 2/1955 | Whitesell | 51/193 |
| 2,778,166 | 1/1957 | Cosmos | 51/141 |
| 2,806,379 | 9/1957 | Haracz | 74/230.3 |
| 2,850,853 | 9/1958 | Simendinger | 51/141 |
| 3,000,149 | 9/1961 | Johnson | 51/141 |
| 3,083,584 | 4/1963 | Nanson | 51/141 |
| 3,273,288 | 9/1966 | Kuris | 51/141 |
| 5,085,010 | 2/1992 | Grau | 51/141 |

OTHER PUBLICATIONS

Coated Abrasives-Modern Tool of Industry; Coated Abrasives Manufacturers' Institute; pp. 111-130 (1965).

3M Contact Wheel-Proper Support for High-quality Grinding; Brochure No. 60-4400-1404-(772)NPI; 3M Industrial Abrasives Division (no date).

*Primary Examiner*—Bruce M. Kisliuk

*Assistant Examiner*—Bo Bounkong

*Attorney, Agent, or Firm*—Gary N. Griswold; Walter M. Kirn; Peter L. Olson

[57] ABSTRACT

The contact wheel according to the present invention comprises an annular support portion having external surfaces, and a generally cylindrical peripheral surface. The peripheral surface has spaced edges each adjoining an adjacent external surface, and circumferentially spaced elongate grooves formed therein with land portions disposed between the grooves. The grooves are spaced from the respective adjacent edges of the peripheral surface to provide annular land surfaces at each edge of the peripheral surface. The contact wheel further includes one or more passageways formed therein, which communicate with a groove at a first end of the passageway, and with either an external surface of the annular support portion, or an adjacent groove at a second end of the passageway. The passageways aid in reducing the amount of noise generated by the contact wheel when it is rotated with the abrasive belt entrained thereover.

14 Claims, 3 Drawing Sheets

CONTACT WHEEL

TECHNICAL FIELD

The present invention relates to a contact wheel for supporting a coated abrasive belt during the process of abrading a workpiece. Specifically, the contact wheel of the present invention reduces noise produced by the rotation of the contact wheel during the abrading process.

BACKGROUND OF THE INVENTION

Grinding machines are often used to abrade material from a workpiece, such as a forging or casting, or to impart a finish to the workpiece. One such grinding machine is known as a backstand grinder, and it includes a contact wheel and at least one idler wheel, which support an endless coated abrasive belt. The relative positions of the contact wheel and the idler wheel are adjustable to maintain adequate tension in the abrasive belt. The workpiece may then be pushed against an exposed abrasive face of the abrasive belt, either manually or by a machine, in the area where the belt is supported by the contact wheel, to abrade material from the contacted surface of the workpiece. The area where the workpiece contacts the abrasive face of the belt will be referred to herein as the abrading interface.

Contact wheels may be constructed in one of several manners. For example, the entire contact wheel may be constructed from a material such as rubber or steel. Alternately, the contact wheel may include a rigid inner hub (constructed of metal, for example) surrounded by a resilient tread (constructed of rubber, for example).

The surface characteristics of a contact wheel have been shown to impact the cut rate (i.e. the rate of material removal from the workpiece by the abrasive belt) and the resultant surface finish of the workpiece. A plain-faced contact wheel, which has a generally cylindrical continuous outer periphery, is typically used for very fine polishing or burnishing, depending on the durometer of the wheel. Plain-faced contact wheels provide the lowest effective pressure at the interface between the workpiece and the abrasive belt. However, it may be desirable to increase the effective pressure at the abrading interface, which led to the development of the serrated, or grooved contact wheel.

Serrated contact wheels include a plurality of grooves formed in and extending across the peripheral face of the contact portion of the wheel. These grooves result in a contact wheel having alternate lands and grooves in the face of the wheel, which increase the effective pressure at the abrading interface. Because serrated contact wheels produce higher effective pressures at the abrading interface, they produce a higher cut rate. Factors such as the ratio of groove width to land width, the depth of the groove, the shape of the land, and the hardness of the wheel each affect the cut rate and the performance of the coated abrasive belt. Thus, serrated contact wheels are particularly suitable for grinding operations that require a relatively large amount of material removal.

Serrated contact wheels, however, may engender certain difficulties that make such wheels undesirable. For example, constant flexing of the land portions of the contact wheel tends to cause fatigue, and the life cycle of the contact wheel may therefore be diminished. Furthermore, abraded material may tend to build up on the hub of the contact wheel, which can cause the wheel to become imbalanced and to abrade unevenly—a problem that is also germane to plain-faced contact wheels. Most importantly, when an operator abrades a workpiece at the edge of the contact wheel, higher effective pressures can occur, which can result in damage to or destruction of the outer edge of the abrasive belt. The abrasive belt tends to become "shelled," meaning that the abrasive particles cease to be bonded to the belt, and may be stripped from the backing during abrading. Given that the land areas at the edges of the contact wheel are particularly susceptible to flexing, and tend to become fatigued relatively quickly, the serrated contact wheel may be inadequate for some applications.

A third type of contact wheel that is thought to overcome the problems described above is a hybrid contact wheel. As shown with respect to the present invention in FIG. 2, a hybrid contact wheel includes circumferentially spaced grooves in the peripheral face of the contact portion of the wheel. These grooves are spaced from each side of the contact wheel, which provides annular land surfaces at each outer edge of the wheel. Thus, the contact wheel in essence includes serrated portions and plain-faced portions. The hybrid contact wheel decreases flexing of the land portions, particularly near the outer edges of the wheel, which results in longer product life. The edges of the belt, due to the lower pressure superjacent the annular, plain-faced land surfaces, last longer and are more resistant to shelling. Finally, the cut rate proximate the center of the belt is greater than a serrated contact wheel, perhaps due to the increased support provided by the annular support portions. Thus the hybrid contact wheel solves many of the problems displayed by the plain-faced and serrated contact wheels.

The hybrid contact wheel exhibits at least two undesirable side effects. First, abraded material may accumulate on the hub of the contact wheel, potentially resulting in wheel imbalance and uneven abrading. Second, and more critically, hybrid contact wheels typically generate unacceptably high levels of noise during use. For example, noise measurements proximate the contact wheel (i.e. 8 inches away) may approach 110 dBA (see infra, Example One). The threshold of pain in response to sound may, depending on the frequency, be between 110 and 130 dBA. Thus, prolonged exposure to the noise produced by a contact wheel, if not painful, may be irritating or uncomfortable to an operator who is working on or near the abrading apparatus. In addition to the potential for hearing difficulty, increased noise makes communication on the shop floor more difficult, with the concomitant risks of an accident or injury due to an inability to communicate effectively.

It is therefore desirable to provide a hybrid contact wheel that produces less noise, and is less susceptible to the build-up of abraded material on the hub, than known hybrid contact wheels.

SUMMARY OF THE INVENTION

The present invention includes a contact wheel for supporting an endless abrasive belt having a back face for contact with the contact wheel and a front abrasive face for rotatively abrading a workpiece. The contact wheel includes an annular support portion having external surfaces and a generally cylindrical peripheral surface for contact with the back face of the abrasive belt. The peripheral surface has spaced edges each adjoining an adjacent external surface, and circumferentially spaced elongate grooves formed therein with land portions disposed between the grooves. The grooves are spaced from the respective adjacent edges of the peripheral surface to provide annular land surfaces at each edge of the peripheral surface, and the annular land surfaces are coterminous with the land portions.

The contact wheel also includes at least one passageway formed in the contact wheel, the passageway having a first end and a second end, the passageway communicating at the first end with a groove, and at the second end with an external surface of the annular support portion, to reduce the amount of noise produced by the contact wheel as it is rotated with the abrasive belt entrained thereover. In another embodiment, the passageway communicates at the first end with a groove, and at the second end with an adjacent groove, to reduce the amount of noise produced by the contact wheel as it is rotated with the abrasive belt entrained thereover.

Another aspect of the present invention is a method of reducing the amount of noise generated by a contact wheel. The method includes the steps of providing a contact wheel in accordance with the second preceding paragraph, and forming at least one passageway in the contact wheel. The passageway communicates with a groove at a first end of the passageway and with an external surface of the annular support portion at a second end of the passageway. In another embodiment, the passageway communicates a groove with an adjacent groove. In another embodiment, the method further includes the step of forming two passageways in each of the grooves.

The present invention also includes an abrading apparatus for abrading material from a workpiece. The apparatus includes a frame, a contact wheel (including at least one passageway as described above) rotatively mounted on the frame, an idler wheel mounted on the frame and spaced from the contact wheel, an endless abrasive belt entrained over the contact portion of the contact wheel and over the idler wheel, and a motor for rotating one of the contact wheel and the idler wheel to rotate the abrasive belt. The rotating means, the contact wheel, and the idler wheel cooperatively rotate the abrasive belt to abrade the workpiece as the workpiece is pushed against the abrasive belt superjacent the contact wheel.

DESCRIPTION OF THE DRAWINGS

The present invention will be further described with reference to the accompanying drawing wherein like reference numerals refer to like parts in the several views, and wherein.

DETAILED DESCRIPTION OF THE INVENTION

Figure 1:
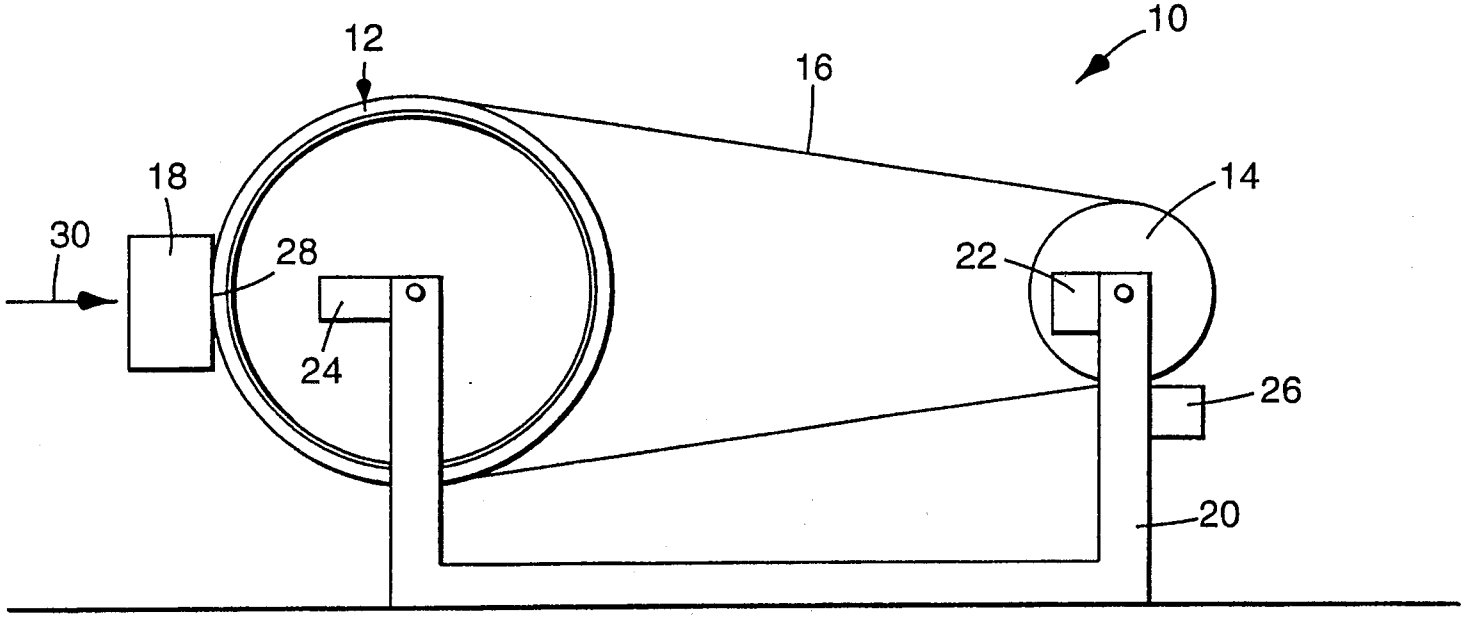
FIG. 1 is a schematic representation of a grinding machine that includes a contact wheel and a workpiece to be abraded.

As shown in FIG. 1, the present invention is adapted for use with a grinding assembly 10, which may be of the type sold by KLK Industries, of Crystal, Minn., or G & P Industries of Indianapolis, Ind. Grinding assembly 10 includes a contact wheel 12 and an idler wheel 14 supporting an endless abrasive belt 16. Abrasive belt 16 could be of the type sold by Minnesota Mining and Manufacturing, St. Paul Minn., under the trade designations 3M 963G "Regal" TM Resin Bond Cloth Belts, or 3M 331D "Three-M-ite" TM Resin Bond Cloth Belts, or 3M 359F "Multicut" TM Resin Bond Cloth Belts. Abrasive belt 16 includes a flexible backing having a plurality of abrasive grains or agglomerates bonded to the exposed front surface of the backing for abrading workpiece 18.

Contact wheel 12 and idler wheel 14 are supported and spaced by a frame 20, and a tensioning mechanism 22 is provided to adjust the tension in abrasive belt 16. A drive mechanism 24 rotatively drives contact wheel 12, but could be adapted to drive idler wheel 14 instead. A tracking means that ensures the abrasive belt 16 tracks properly is provided in the form of belt tracking device 26, which may comprise a crowned idler wheel, a center pivot tracking system or a pneumatic tracker. During grinding, the contact wheel 12 supports the coated abrasive belt 16 at the abrading interface 28. Workpiece 18 may be pushed in direction 30 against rotating abrasive belt 16 to abrade material from the workpiece. Grinding assembly 10 is intended to be illustrative rather than limiting, and thus the contact wheel of the present invention should be understood to have applicability with any suitable grinding assembly.

The genre of contact wheel with which the present invention is concerned is the hybrid contact wheel. Contact wheel 12 may be constructed from any suitable material, such as steel, or natural or synthetic rubber having a Shore A durometer preferably between 15 and 100. In general, contact wheel 12 includes an annular support portion 32 having external surfaces, and a generally cylindrical peripheral surface 58. Annular support portion 32 may be monolithic (meaning that the contact wheel is formed in a unitary piece), or made of two or more components, as shown in the illustrated embodiments.

Figure 5:
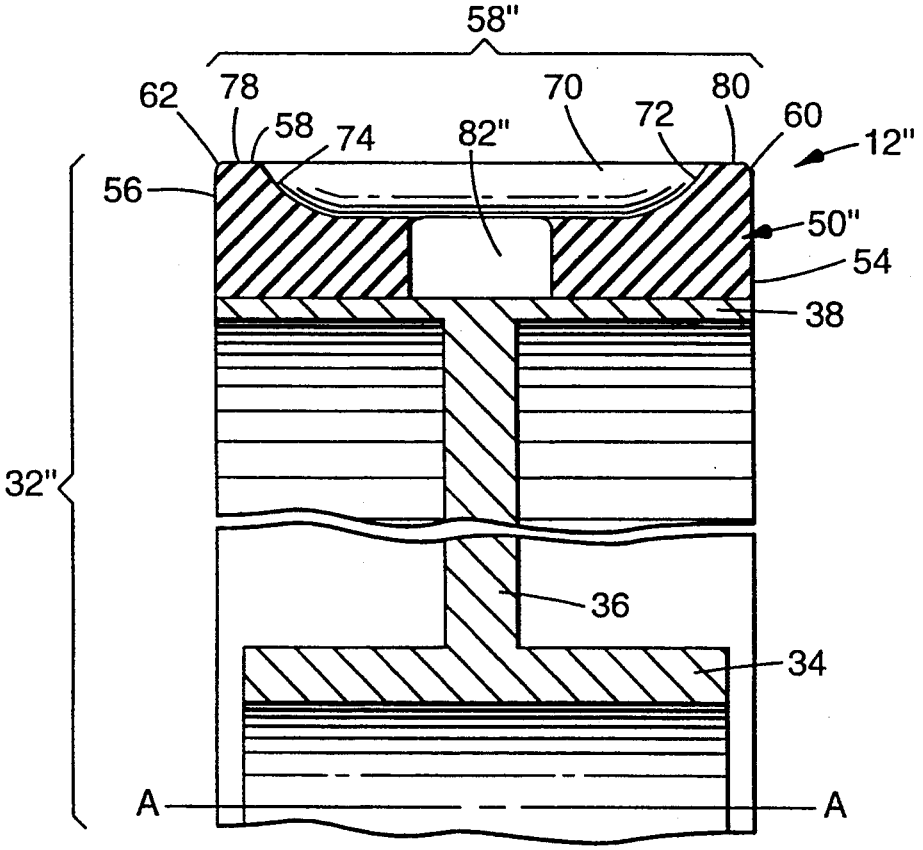
FIG. 5 is a sectional view of an alternate embodiment of the contact wheel of the present invention.
Figure 4:
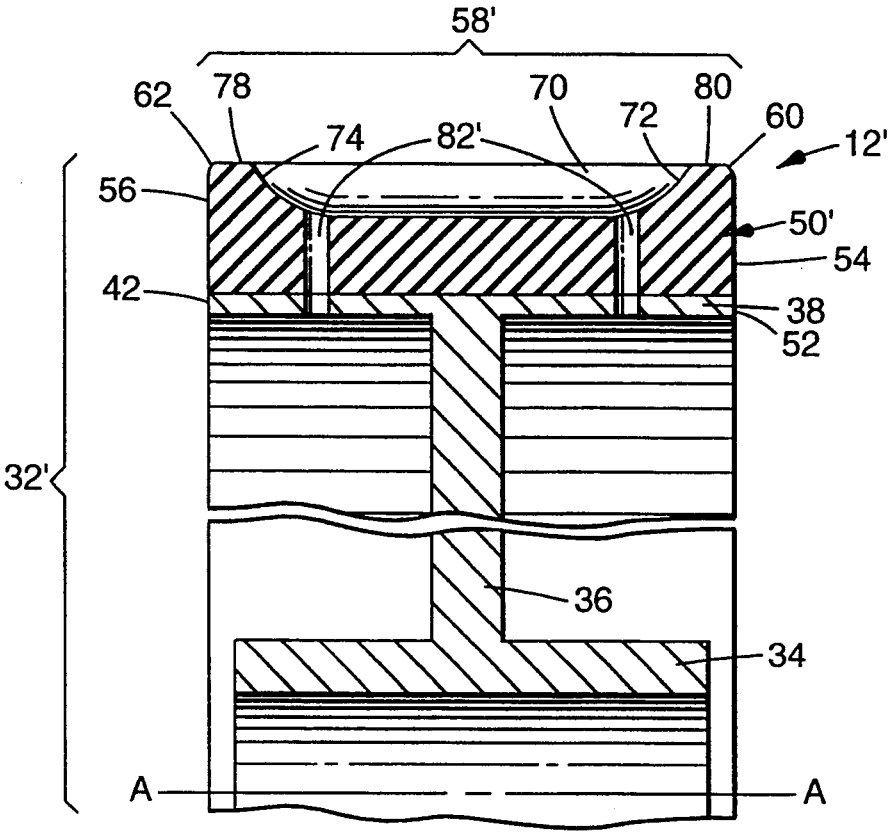
FIG. 4 is a sectional view of an alternate embodiment of the contact wheel of the present invention.
Figure 3:
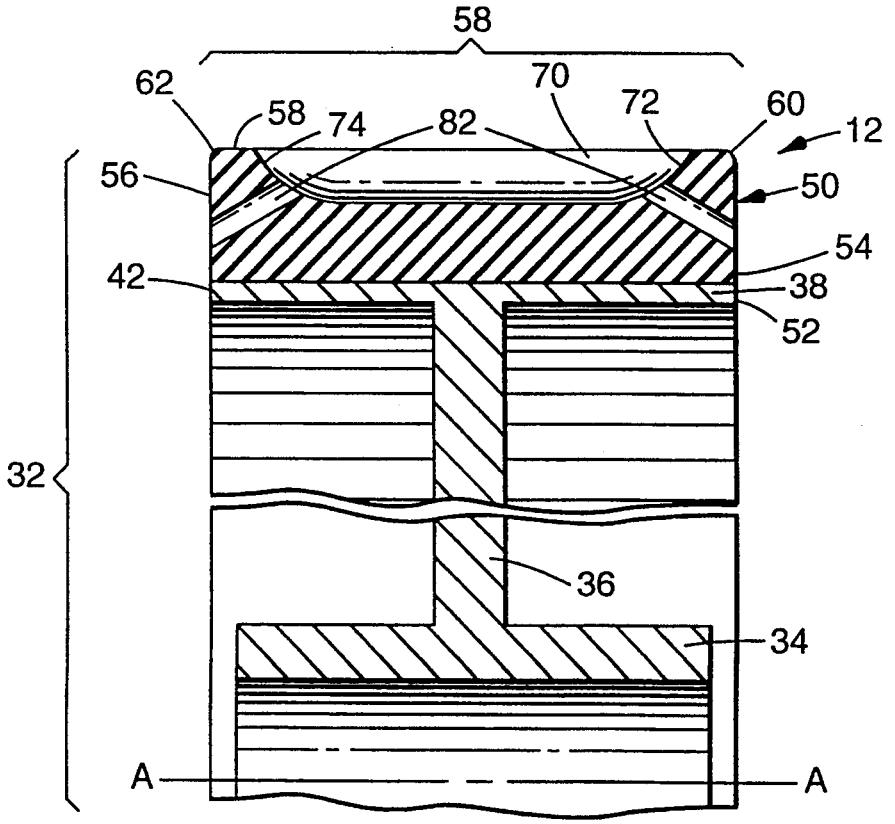
FIG. 3 is a sectional view of the contact wheel of FIG. 2 taken approximately along line 3—3 of FIG. 2.

With reference to the embodiments illustrated in FIGS. 3 through 5, contact wheel 12 includes an annular support portion 32. Annular support portion 32 includes external surfaces, which may be of varying shape and dimension. For example, in FIGS. 3 through 5, annular support portion includes an arbor 34, rim 38, and annular connecting portion 36, each having external surfaces. Annular connecting portion 36 may comprise a plurality of spokes or a contiguous annular disk-like member. In the illustrated embodiment, annular support portion 32 further includes contact portion 50, which includes external side surfaces 54 and 56, which join peripheral surface 58 at spaced edges 60 and 62, respectively. If a separate contact portion 50 is mounted on rim 38 in a two part construction, fastening means such as vulcanization, mechanical fasteners, molding or chemical bonding should preferably be used to prevent relative rotation therebetween. Arbor 34 may be provided for mounting contact wheel 12 on a shaft, to enable rotation by drive mechanism 24.

Peripheral surface 58 includes circumferentially spaced parallel elongate grooves 70 formed therein and each having opposite ends 72 and 74. Land parts 76 of peripheral surface 58 separate adjacent grooves. Grooves 70 may be disposed at an angle between 5 and 85 degrees relative to axis A—A of contact wheel 12, and are preferably disposed at an angle of between 30 and 60 degrees. The ratio between the surface area of the lands and the surface area of the grooves will depend on the particular abrading application and may typically range from 1:9 to 9:1.

Grooves 70 are spaced from edges 60 and 62 to provide annular land surfaces 78 and 80, which are coaxial with axis A—A of contact wheel 12. Annular land surfaces 78 and 80 reduce damage to abrasive belt 16, because they support abrasive belt 16 at the abrading interface near the edges of the contact wheel. Furthermore, annular land surfaces 78 and 80 are coterminous with land portions 76, and provide support for the land portions to reduce undesirable flexing. The reduced flexing of the land portions diminishes the potential for fatigue damage to the lands, particularly at their roots or bases.

The noise reducing aspect of present invention is provided by forming at least one passageway in the contact wheel. The passageway communicates with a groove at a first end of the passageway and with either an external surface of the annular support portion or an adjacent groove at a second end of the passageway. The passageway is believed to equalize the pressure between the groove over which the abrasive belt is entrained and atmospheric pressure, which in turn reduces the amount of noise produced by the apparatus during abrading.

Figure 2:
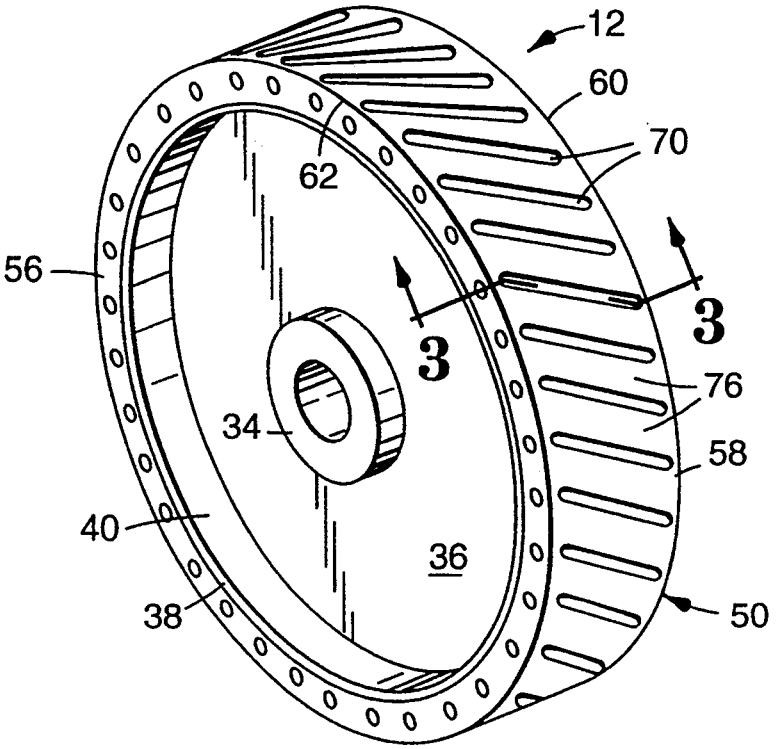
FIG. 2 is a perspective view of a contact wheel according to the present invention.

Three embodiments of the present invention are illustrated in the appended Figures. In FIGS. 2 and 3, passageway 82 is formed between a groove and an adjacent external surface (e.g. 42, 52, 54 or 56). Passageway 82 is typically formed either by drilling, or by being formed when the contact wheel is molded. For example, passageway 82 could be formed by drilling a hole from the passageway to an adjacent external surface.

A second embodiment, shown in FIG. 4, illustrates passageway 82' formed between a groove and external cylindrical surface 40 of rim 38. As with the previous embodiment, passageway 82' is typically formed either by drilling, or by being formed when the contact wheel is molded. In the preferred embodiment, a passageway 82' is formed between each groove and external cylindrical surface 40, which allows air that is expelled from the passageways to blow accumulated debris away from the interior of the rim. This design aids in preventing the otherwise accumulated debris from causing the contact wheel to become imbalanced and to abrade unevenly as a result.

A third embodiment, shown in FIG. 5, illustrates contact wheel 12'' having a passageway 82'' connecting adjacent grooves 70 together. The passageways between adjacent grooves could be formed after contact wheel 12'' is formed (e.g. by drilling), or could instead be formed during the formation of the contact wheel (e.g. by allowing a concentric gap in the layers of rubber and connecting each groove to the gap). By connecting adjacent grooves to each other, air cannot become trapped within any single groove, and noise reduction may result.

Several aspects of the present invention are common to each of the embodiments discussed above. The passageways may be formed in one, several, or all of the grooves, depending on the degree of noise reduction desired. Furthermore, more than one passageway may be formed in a groove. The diameter of the passageways could be less than, equal to, or greater than the width of the grooves in which they are formed, but should not be so large as to functionally impair the land portions (e.g. by making them thin, and therefore susceptible to fatigue). The size, angle, number, and location of the passageways may also be varied, depending on the application, while remaining within the scope of the present invention. Given the numerous geometric configurations that annular support portion 32 could take, it is also within the scope of the present invention to provide passageways connecting one or more grooves to any external surface of the annular support portion, including but not limited to those external surfaces specifically recited herein.

The following example is indicative of the noise reduction feature of the present invention.

EXAMPLE

A hybrid contact wheel having a width of 10.2 cm (4 in) and an overall radius of 17.8 cm (7 in)(comprising a hub radius of 16.2 cm ($6\frac{3}{8}$ in) and a contact portion thickness of 1.6 cm ($\frac{5}{8}$ in)) included perimetrically spaced grooves formed in the contact surface of the wheel. Each groove measured 0.64 cm ($\frac{1}{4}$ in) across, 1.43 cm (9/16 in) deep, and 43.2 cm (4.125 in) long, and terminated approximately 1.27 cm (0.5 in) from the edge of the wheel. The grooves were separated from each other by land portions measuring 0.95 cm ($\frac{3}{8}$ in) across, which were coterminous with annular land surfaces measuring 1.27 cm (0.5 in) wide. The contact portion was constructed of rubber having a Shore A durometer of approximately 85–90. The contact wheel, having a serration pattern designated J72, is available from the Contact Rubber Corp. of Bristol, Wis.

The contact wheel was mounted on a backstand grinding assembly having an idler wheel, and an abrasive belt was supported on and entrained over the two wheels. The belt was rotated at three different speeds, as shown in the chart below, and the noise levels were recorded at a distance of approximately 20.3 cm (8 in) by a Type 451 Sound Level Meter (A weighted), made by Scott Instrument Laboratories, ANSI Type S3A.

After a first set of noise measurements were recorded, two $\frac{1}{4}$" diameter passageways were drilled in each of the grooves in accordance with the embodiment shown generally in FIG. 4. The results of the two sets of measurements are displayed below.

| Belt Speed | Noise Level w/o Passageways | Noise Level w/ Passageways |
|---|---|---|
| 6000 ft/min | 102 dBA | 99 dBA |
| 8000 ft/min | 104 dBA | 102 dBA |
| 10,000 ft/min | 107 dBA | 104 dBA |

Sound intensity is related to the difference in decibel level by the following equation, where $dBA_1$ and $dBA_2$ are the first and second decibel measurements, respectively, and $I_1$ and $I_2$ are the first and second sound intensities, respectively:

$$dBA_2 - dBA_1 = 10 \log_{10}(I_2/I_1).$$

Thus a difference of approximately 3 dBA ($dBA_2 - dBA_1 = 3.0$) is approximately equivalent to doubling the intensity of the sound ($I_2/I_1=1.995$). Stated differently, the use of the present invention in this Example roughly halved the intensity of the sound created by the hybrid contact wheel. The results of this Example are, of course, intended to be illustrative rather than predictive, but the relative advantage of the present invention in reducing sound intensity is evident.

The present invention has now been described with reference to several embodiments thereof. It will be apparent to those skilled in the art that many changes can be made in the embodiment described without departing from the scope of the present invention. For example, the contact wheel could be monolithic, or could be comprised of two or more component parts. Thus the scope of the present invention should not be limited to the structure described in this application, but only by structures described by the language of the claims and the equivalents of those structures.

We claim:

1. A contact wheel for supporting an endless abrasive belt having a back face for contact with the contact wheel and a front abrasive face for rotatively abrading a workpiece, the contact wheel comprising:

(a) an annular support portion having external surfaces;

(b) a generally cylindrical peripheral surface for contact with the back face of the abrasive belt, said peripheral surface having spaced edges each adjoining an adjacent external surface, said peripheral surface having circumferentially spaced elongate grooves formed therein with land portions disposed between said grooves, said grooves spaced from the respective adjacent edges of said peripheral surface to provide annular land surfaces at each edge of said peripheral surface, said annular land surfaces coterminous with said land portions; and (c) at least one passageway formed in said contact wheel, said passageway having a first end and a second end, said passageway communicating at said first end with a groove, and at said second end with an external surface of said annular support portion, to reduce noise produced by the contact wheel as it is rotated with the abrasive belt entrained thereover.

2. The contact wheel of claim 1, wherein said contact wheel comprises at least one passageway communicating with each of said grooves.

3. The contact wheel of claim 2, wherein said contact wheel comprises two passageways communicating with each of said grooves.

4. The contact wheel of claim 1, wherein said contact wheel is monolithic.

5. The contact wheel of claim 1, wherein said annular support portion comprises a generally cylindrical peripheral rim, and a contact portion mounted on said rim.

6. A contact wheel for supporting an endless abrasive belt having a back face for contact with the contact wheel and a front abrasive face for rotatively abrading a workpiece, the contact wheel comprising:

(a) an annular support portion having external surfaces;

(b) a generally cylindrical peripheral surface for contact with the back face of the abrasive belt, said peripheral surface having spaced edges each adjoining an adjacent external surface, said peripheral surface having circumferentially spaced elongate grooves formed therein with land portions disposed between said grooves, said grooves spaced from the respective adjacent edges of said peripheral surface to provide annular land surfaces at each edge of said peripheral surface, said annular land surfaces coterminous with said land portions; and (c) at least one passageway formed in said contact wheel, said passageway having a first end and a second end, said passageway communicating at said first end with a groove, and at said second end with an adjacent groove, to reduce noise produced by the contact wheel as it is rotated with the abrasive belt entrained thereover.

7. The contact wheel of claim 6, wherein said contact wheel is monolithic.

8. The contact wheel of claim 6, wherein said annular support portion comprises a generally cylindrical peripheral rim, and a contact portion mounted on said rim.

9. A method of reducing the amount of noise generated by a contact wheel, comprising the steps of:

(a) providing a contact wheel, comprising:

(i) an annular support portion having external surfaces;

(ii) a generally cylindrical peripheral surface for contact with the back face of the abrasive belt, the peripheral surface having spaced edges each adjoining an adjacent external surface, the peripheral surface having circumferentially spaced elongate grooves formed therein with land portions disposed between the grooves, the grooves spaced from the respective adjacent edges of the peripheral surface to provide annular land surfaces at each edge of the peripheral surface, the annular land surfaces coterminous with the land portions; and (b) forming at least one passageway in the contact wheel, said passageway having a first end and a second end, said passageway communicating at said first end with a groove, and at said second end with an external surface of said annular support portion, to reduce noise produced by the contact wheel as it is rotated with the abrasive belt entrained thereover.

10. The method of claim 9, wherein step (b) comprises forming at least one passageway in each of the grooves.

11. The method of claim 10, wherein step (b) further comprises forming two passageways in each of the grooves.

12. The method of claim 9, wherein step (b) comprises drilling the passageway in the contact portion.

13. An abrading apparatus for abrading material from a workpiece, comprising:

(a) a frame;

(b) a contact wheel rotatively mounted on said frame, comprising:

(i) an annular support portion having external surfaces;

(ii) a generally cylindrical peripheral surface for contact with the back face of the abrasive belt, said peripheral surface having spaced edges each adjoining an adjacent external surface, said peripheral surface having circumferentially spaced elongate grooves formed therein with land portions disposed between said grooves, said grooves spaced from the respective adjacent edges of said peripheral surface to provide annular land surfaces at each edge of said peripheral surface, said annular land surfaces coterminous with said land portions; and (iii) at least one passageway formed in said contact wheel, said passageway communicating with a groove at a first end of said passageway and with an external surface of said annular support portion at a second end of said passageway, to reduce the amount of noise produced by the contact wheel as it is rotated with the abrasive belt entrained thereover;

(c) an idler wheel mounted on said frame and spaced from said contact wheel;

(d) an endless abrasive belt entrained over said contact portion of said contact wheel and over said idler wheel; and (e) means for rotating one of said contact wheel and said idler wheel to rotate said abrasive belt;

whereby said rotating means, said contact wheel, and said idler wheel cooperatively rotate said abrasive belt to abrade the workpiece as the workpiece is pushed against the abrasive belt superjacent said contact wheel.

14. An abrading apparatus for abrading material from a workpiece, comprising:

(a) a frame;

(b) a contact wheel rotatively mounted on said frame, comprising:

(i) an annular support portion having external surfaces;

(ii) a generally cylindrical peripheral surface for contact with the back face of the abrasive belt, said peripheral surface having spaced edges each adjoining an adjacent external surface, said peripheral surface having circumferentially spaced elongate grooves formed therein with land portions disposed between said grooves, said grooves spaced from the respective adjacent edges of said peripheral surface to provide annular land surfaces at each edge of said peripheral surface, said annular land surfaces coterminous with said land portions; and (iii) at least one passageway formed in said contact wheel, said passageway communicating with a groove at a first end of said passageway and with an adjacent groove at a second end of said passageway, to reduce noise produced by the contact wheel as it is rotated with the abrasive belt entrained thereover;

(c) an idler wheel mounted on said frame and spaced from said contact wheel;

(d) an endless abrasive belt entrained over said contact portion of said contact wheel and over said idler wheel; and (e) means for rotating one of said contact wheel and said idler wheel to rotate said abrasive belt;

whereby said rotating means, said contact wheel, and said idler wheel cooperatively rotate said abrasive belt to abrade the workpiece as the workpiece is pushed against the abrasive belt superjacent said contact wheel.

* * * * *

UNITED STATES PATENT AND TRADEMARK OFFICE

CERTIFICATE OF CORRECTION

PATENT NO. : 5,339,570

DATED : Aug. 23, 1994

INVENTOR(S) : Amundson et al.

It is certified that error appears in the above-indentified patent and that said Letters Patent is hereby corrected as shown below:

Col. 3, line 54, "drawing" should be --drawings--.

Col. 4, line 11, insert a comma between "St. Paul" and "Minnesota".

In claim 13, column 9, line 8, "the amount of" should be deleted.

Signed and Sealed this

Thirteenth Day of June, 1995

*Attest:*

Bruce Lehman

BRUCE LEHMAN

*Attesting Officer*

*Commissioner of Patents and Trademarks*